US005726120A

United States Patent [19]

Williams et al.

[11] Patent Number: 5,726,120

[45] Date of Patent: Mar. 10, 1998

[54] CF SHEET FOR CARBONLESS COPY PAPER AND WEATHER RESISTANT TAGS INCORPORATING SAME

[75] Inventors: Rodney E. Williams, Fremont, Ohio; Kenneth D. Riggs, Gurnee, Ill.

[73] Assignee: Moore Business Forms, Inc., Grand Island, N.Y.

[21] Appl. No.: 488,023

[22] Filed: Jun. 7, 1995

[51] Int. Cl.[6] ..... B41M 5/40

[52] U.S. Cl. ..... 503/214; 427/152; 503/200; 503/225; 503/226; 283/74

[58] Field of Search ..... 427/150, 151, 427/152; 503/200, 214, 216, 225, 226; 283/74

[56] References Cited

U.S. PATENT DOCUMENTS

| | | | |
|---|---|---|---|
| 3,663,256 | 5/1972 | Miller et al. | 503/225 |
| 3,993,500 | 11/1976 | Isaac et al. | 503/219 |
| 4,387,913 | 6/1983 | Torii et al. | 503/225 |
| 4,591,887 | 5/1986 | Arbree et al. | 503/200 |
| 4,927,801 | 5/1990 | Mahmud | 503/200 |
| 4,992,412 | 2/1991 | Fetters | 503/225 |
| 4,999,334 | 3/1991 | Mehta et al. | 503/226 |
| 5,075,369 | 12/1991 | Mahmud | 524/475 |
| 5,141,914 | 8/1992 | Kang | 503/226 |
| 5,151,403 | 9/1992 | Suzuki et al. | 503/200 |
| 5,162,289 | 11/1992 | Betts et al. | 503/226 |
| 5,351,993 | 10/1994 | Wright et al. | 283/62 |

FOREIGN PATENT DOCUMENTS

| | | | |
|---|---|---|---|
| 0059889 | 4/1983 | Japan | 503/200 |

*Primary Examiner*—Bruce H. Hess

*Attorney, Agent, or Firm*—Finnegan, Henderson, Farabow

[57] ABSTRACT

A coated front sheet useful in carbonless copy forms. The sheet has a moisture resistant coating of latex binder, color developer, and pigment in association with a substrate. The coating is formulated to permit formation of a legible image in use in the carbonless copy form, and to minimize the adverse effects of humid weather conditions. The substrate is resistant to degradation by moisture, and may be a moisture resistant polymer or paper impregnated with the moisture resistant coating.

6 Claims, No Drawings

CF SHEET FOR CARBONLESS COPY PAPER AND WEATHER RESISTANT TAGS INCORPORATING SAME

BACKGROUND OF THE INVENTION

1. Field of the Invention

The invention relates to a copy sheet, and in particular, a carbonless copy sheet that provides good product stability even when the sheet is exposed to a moist environment. The copy sheets of this invention are particularly useful in a wide variety of applications that require stability in severe weather conditions.

2. Description of Related Art

Carbonless copy forms are well known in the copying industry, and have been utilized in a wide variety of applications and environments. A typical carbonless copy form comprises at least two sheets arranged in juxtaposed contact with each other. A first sheet (typically called the "CB" or coated back sheet) comprises a substrate with a coating on its lower surface. The coating contains a binder with microcapsules containing a color former. A second sheet (typically called the "CF" or coated front sheet) comprises a substrate coated with a layer containing developer. The color former and developer are selected such that when they come into physical contact, a chemical reaction occurs that produces a distinct color.

When imaging pressure is exerted on the copy form by writing, typing or otherwise applying selective pressure, the microcapsules are ruptured in a selective pattern thereby releasing or transferring the color forming material in a corresponding pattern to the layer containing developer. A chemical reaction occurs and produces in the CF sheet a color image corresponding to the imaging pressure. If more than one copy is desired, it is conventional to add one or more intermediate sheets containing a color former coating on one side and a color developer layer on the other side. The sheets are arranged so that a color former coating on one sheet is placed in contact with a color developing layer on an adjacent sheet.

Manufacturers of carbonless copy forms have long sought a product that provided a stable image of high intensity. Images decompose or are otherwise damaged by exposure to sunlight or atmospheric moisture. The coatings containing the developer material must achieve a balance between being sufficiently porous to permit the color forming material to penetrate to a sufficient depth to create a sharp and dense image, yet not so porous that the image is unprotected from environmental factors that will diminish the image quality. If the surface of the coating containing the developer material is not porous enough, the image will not form. If the surface of the coating is too porous, the image is readily degraded. This balance has been particularly difficult to achieve where the form is to be used in adverse weather conditions.

CF coatings known in the prior art typically contain a water soluble binder or viscosity control additive that increases the attraction of the coating surface to moisture. It has been observed that the presence of atmospheric moisture is a major factor in the tendency of an image produced in a carbonless form to fade. Apparently, the action of oxygen or other oxidizing agents in degrading the chemical reaction product that creates the image is accelerated in a humid or moist environment.

There is a need for a carbonless copy sheet that produces a high intensity image that will be stable in a variety of weather conditions, particularly those involving exposure to excessive moisture. There is also a need for a sheet that can be used in a variety of outdoor applications such as hunting license tags, lumber tags, crop or game tags, luggage tags, tags for disabled vehicles, tags for crime scene investigations and the like.

The present inventors have found that the coated front sheet of the invention, when used in a carbonless copy form, has low affinity for water, reduces image fading, and retains dimensional stability even when exposed to humid and moist environments.

SUMMARY OF THE INVENTION

To achieve the advantages and in accordance with the purpose of the invention, as embodied and broadly described herein, a coated front (CF) sheet for use in carbonless copy paper is provided. The sheet includes a substrate that is resistant to degradation by water, and a moisture resistant coating on the substrate containing a latex binder, a color developer, and a pigment. The substrate can be paper impregnated with a moisture resistant coating, or can be a moisture resistant polymer. The coated front sheet is particularly suited for use, along with a coated back sheet, as carbonless paper for weather resistant tags.

DETAILED DESCRIPTION OF THE INVENTION

The moisture resistant coating of the present invention is formulated to avoid the use of water soluble or other hydrophilic components. Since conventional prior art CF coatings contain either water soluble binders or viscosity control additives, these coatings tend to have surfaces that attract moisture. These water soluble components have been found to reduce the stability of the image formed in the CF sheet, and to contribute to the dimensional instability of the CF sheet when exposed to a variety of weather conditions involving high moisture content.

According to the present invention, water soluble components in the CF coating are avoided by using a mixture of latex binder, developer and pigment in proportions that will bond the coating to the substrate, provide a coating of the desired porosity that will permit the color former to penetrate deep into the coating to form a dark image, yet resist attack on the image under moist conditions, and will be resistant to degradation under moist conditions. Although it will be understood by those skilled in the CF coating art that the proportions of ingredients will vary depending on the precise materials selected and the properties considered to be optimum for any particular application of the CF sheets of the present invention, the preferred relative proportions of ingredients in the CF coating of the present invention are as follows:

color developer—10–70% pigments—10–85% latex binder—5–30%

Throughout the specification and claims, all parts and percentages are by weight unless otherwise indicated.

The color developer of the present invention can be any reactant that will form an image with a color forming reactant when the two materials are brought into contact. Color developer materials with low water solubility and low affinity for moisture are preferred. Phenolic resin color developer materials are particularly suitable for use in the invention and include those described in Fetters U.S. Pat. No. 4,992,412, which is incorporated herein by reference.

These resins are condensation products of phenols and formaldehyde. Representative of the phenolic resins that are commercially available that can be used with this invention include HRJ-2456, available from the Schenectady Chemical Co, Inc. of Schenectady, N.Y.

The pigment ingredient of the coating according to this invention is selected to be added in an amount that will, in combination with the other ingredients selected, adjust the porosity of the coating to the desired level. Pigments which may be used in the coating of this invention include colloidal silica, aluminum trihydrate, structured kaolin, calcined kaolin, and precipitated calcium carbonate. These pigments are available from a number of commercial suppliers. One particularly preferred pigment is a calcined kaolin pigment, known as ansilex, available from Engelhard Corporation of Edison, N.J.

The latex binder of the CF coating of the invention is selected to provide a moisture resistant coating that adheres to the substrate. The amount of binder used is that sufficient to effectively bind the formulation to the substrate. Effective binding is achieved when the coated surface of the copy sheet can receive commercial printing inks without picking off or flaking during the printing operation. Effective binding is only one of the important properties that characterizes the binders of the present invention. Many effective binders also tend to be good film formers, a property that often has an adverse affect on surface porosity. An appropriate amount of filler material is used to enhance the porosity of the surface of the CF sheet to a level that achieves an optimum balance between surface porosity and the integrity of the coating.

Materials that can be used as effective binders in the formulation of the present invention include latex binders commonly used in the coatings and paper manufacturing industries. A particularly preferred example of a commercial latex binding material than can be used with this invention is a carboxylated styrene-butadiene latex (SBR), known as Dow 620, available from the Dow Chemical Company of Moorestown, N.J.

The substrate used according to this invention may be any substrate suitable for supporting the moisture resistant coating of the present invention. Paper is typically used as the substrate of choice in commercial carbonless copy forms. Where the copy sheet layer is to be used in adverse weather conditions, the substrate must be able to maintain its dimensional stability under those conditions. Accordingly, it is particularly desirable, according to this invention, to select a substrate that is durable.

The substrate according to this invention may be a paper made from either cellulose or polymer fiber. The resistance of the substrate to adverse weather conditions can be enhanced by a protective hydrophobic coating of water insoluble material that either coats or impregnates the cellulose substrate material, or by the selection of a suitable polymeric fiber that is water resistant. A commercially available substrate material that can be used for the purposes of this invention is marketed as Duraform by Kimberly Clark of Roswell, Ga., which is a proprietary mixture of polymeric fibers and latex binding materials.

A particularly effective embodiment of the present invention is achieved by applying the coating of the present invention to a fibrous substrate so that the coating impregnates the substrate to form a moisture resistant surface on the copy sheet and the fibers of the substrate. Impregnating the substrate enhances the bond between the coating and the substrate and enhances the structural integrity of the copy sheet by providing protection against the degrading effects of moisture.

The coated front sheet of the invention can take many forms depending on the ultimate use that is intended. As described above, the sheet of the invention is particularly adapted for those uses which require resistance against degradation in adverse weather conditions, One suitable application of the coated front sheets of the invention would be for a hunting license of the type described in U.S. Pat. No. 5,351,993 to Kenneth D. Wright et al. Other potential uses include, for example, lumber tags, plant or tree identification tags such as in a nursery or retail environment, automobile tags for impound yards or dealer lots, cotton or tobacco bale tags, crop markings, luggage that is left outside or becomes subject to weathering, crime scene investigation tags, and the like.

The moisture resistant coating according to this invention can be applied either uniformly to the entire surface of the substrate, or can be spot coated onto selected portions of the substrate. The selection of a particular configuration for coating will depend on how the complete copy form is to be used. In a hunting license application, for example, it may be desirable to have only a portion of the sheet contain a coating that will be subject to imaging by the selective application of pressure, while the balance of the sheet contains some preprinted information and is not subject to alteration or imaging by the selective application of pressure.

In accordance with the invention, the coating formulation may be applied by conventional techniques such as flexo, gravure, reverse roll, air-knife, etc. A metering rod or blade may be used to control application rates. It may be full-coated or spot coated. Drying of the coating may be effected by conventional means such as hot air convection, microwave, or infrared.

For the purposes of this invention, suitable paper stock material could be in the range of 20–100 pounds per ream, and preferably 85 pounds per ream. The moisture resistant coating could be applied to the stock material at the rate of 2–10 pounds per ream, preferably 2–6 pounds per ream, and most preferably between 3–4 pounds per ream.

A coating according to this invention may comprise the following ingredients based on dry weights, including active resin solids for the phenolic resin ingredient:

| | Dry Rate | Normal Solids in Slurry |
|---|---|---|
| pigment (ansilex) | 76% | 40% |
| phenolic resin (HRJ-2456) | 13% | 53% (48.5% active) |
| SBR latex (Dow 620) | 11% | 50% |

It will be apparent to those skilled in the art that various modifications and variations can be made in the copy sheet of the invention without departing from the spirit or scope of the invention. Thus, it is intended that the present invention cover modifications and variations of this invention provided that they come within the scope of the appended claims and their equivalents.

What is claimed is:

1. A coated front sheet for use in carbonless copy paper comprising:

a moisture resistant substrate including polymeric fibers and a latex binder; and a moisture resistant coating on the substrate containing a latex binder, a phenolic resin color developer, and a pigment.

2. The sheet of claim 1, wherein the ingredients of the coating are present in an amount, by weight, of:

latex binder—5–30%, color developer—10–70%, and pigment—10–85%.

3. The sheet of claim 1, wherein the binder is present in an amount that will bind the coating ingredients to the substrate and the coating ingredients are selected to minimize the affinity of the coating to moisture.

4. The sheet of claim 1, wherein the latex binder in the moisture resistant coating is a carboxylated styrene butadiene latex.

5. The sheet of claim 1, wherein the pigment is calcined kaolin.

6. A weather resistant tag comprising:

the coated front sheet of claim 1; and a coated back sheet in juxtaposed contact with said coated front sheet.

* * * * *